US006811096B2

(12) United States Patent
Frazier et al.

(10) Patent No.: US 6,811,096 B2
(45) Date of Patent: Nov. 2, 2004

(54) SPRAY GUN WITH INTERNAL MIXING STRUCTURE

(75) Inventors: Keith Frazier, Selmer, TN (US); Johnny Moore, Adamsville, TN (US)

(73) Assignee: Aqua Glass Corporation, Adamsville, TN (US)

( * ) Notice: Subject to any disclaimer, the term of this patent is extended or adjusted under 35 U.S.C. 154(b) by 0 days.

(21) Appl. No.: 10/331,214

(22) Filed: Dec. 30, 2002

(65) Prior Publication Data

US 2004/0124268 A1 Jul. 1, 2004

(51) Int. Cl.[7] ..... A62C 31/00

(52) U.S. Cl. ..... 239/398; 239/407; 239/413; 137/896

(58) Field of Search ..... 239/398, 407, 239/413, 414, 419, 406; 137/896

(56) References Cited

U.S. PATENT DOCUMENTS 3,658,302 A * 4/1972 Duthion et al. ..... 366/119
3,690,557 A * 9/1972 Higgins ..... 239/407
3,799,403 A * 3/1974 Probst et al. ..... 222/135
3,831,631 A * 8/1974 Draxler ..... 137/606
4,428,530 A * 1/1984 Chabria ..... 239/8
4,453,670 A * 6/1984 Sirovy ..... 239/117
6,605,248 B2 * 8/2003 Rudisill et al. ..... 264/555
6,663,021 B1 * 12/2003 Scarpa et al. ..... 239/424
6,675,988 B2 * 1/2004 Cline et al. ..... 222/55

FOREIGN PATENT DOCUMENTS

GB 2035138 A * 6/1980
JP 406218312 A * 8/1994

* cited by examiner

*Primary Examiner*—William Doerrler
*Assistant Examiner*—Mohammad M. Ali
(74) *Attorney, Agent, or Firm*—Carlson, Gaskey & Olds

(57) ABSTRACT

A spray gun used for manufacturing fiberglass components includes a valve body and a manifold that each contain two channels to initially separate a resin and a catalyst from each other. The channels inside the manifold converge to a vertex to allow the catalyst and resin to impinge each other. The impinged catalyst and resin are then mixed together more thoroughly in a static mixer before being sprayed out of the gun. The spray gun can be used to mix and apply any material made of two or more fluids mixed together.

23 Claims, 5 Drawing Sheets

SPRAY GUN WITH INTERNAL MIXING STRUCTURE

TECHNICAL FIELD

The present invention is directed to spray guns, and more particularly to spray guns used to spray a mixture of two or more fluids.

BACKGROUND OF THE INVENTION

Spray guns are often used in fiberglass component manufacturing processes that spray a substrate or component with a liquid resin material. As is known in the art, many liquid resins used in spray coating processes involve mixing resin with a catalyst that initiates polymerization in the resin. Once this mixture is sprayed onto the substrate, the resin continues to polymerize until it sets and hardens.

To control the flow of this mixture, spray guns often include a valve body having a valve control unit in front of a mixing chamber. Both the valve body and the mixing chamber need to be periodically flushed during routine maintenance. Because the resin and catalyst are mixed well before the mixture is sprayed out of the gun, however, the mixture begins to polymerize inside the mixing chamber and the valve body. This early polymerization causes the mixture to leave a film inside the mixing chamber and the valve body as it travels through the gun before it is sprayed out. This film often cannot be completely removed during the flushing process, making it necessary to replace spray gun components on a regular basis as they become clogged with hardened resin residue.

Further, existing spray guns contain a large number of parts and seals that potentially leak, decreasing the reliability of the gun as well as increasing manufacturing costs. Also, currently used spray guns often have relatively small fluid channels, which encourage high fluid velocity of the resin mixture as it travels through the spray gun. However, the high fluid velocity tends to cause internal wear within the channels, requiring increased maintenance and part replacement.

There is a desire for a spray gun that avoids the leakage and maintenance problems experienced by currently known spray guns.

SUMMARY OF THE INVENTION

Accordingly, the present invention is directed to a spray gun having a valve body and a manifold that each contain two channels to keep two different fluids separated from each other. The channels in the manifold converge at a vertex, directing the two different fluids to impinge each other inside the manifold. In one embodiment, the manifold directs a catalyst and a resin to impinge immediately before they are sent to a mixer, where they are mixed together more thoroughly before being sprayed out of the gun. By keeping the catalyst and resin separate and mixing them just before they are output, the inventive structure prevents buildup of a polymerized resin film inside the valve body and manifold and ensures that the manifold can be completely cleaned during a flushing process.

Other embodiments of the spray gun incorporate a static mixer that mixes the two fluids together, a removable spray tip held onto the spray gun with a tip holder, and/or rigid seals disposed on the manifold. The inventive structure therefore minimizes the total number of parts in the spray gun and configures the existing parts to minimize the amount of maintenance they require.

DETAILED DESCRIPTION OF THE EMBODIMENTS

Figure 1A:
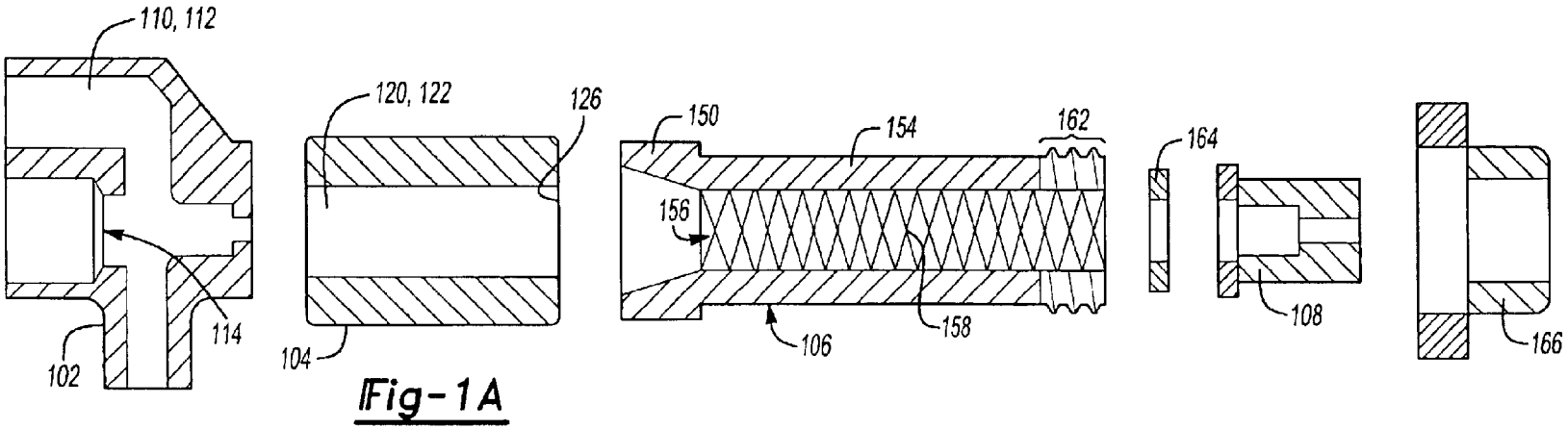
FIGS. 1A and 1B are representative side and top views, respectively, of a spray gun according to one embodiment of the invention.
Figure 1B:
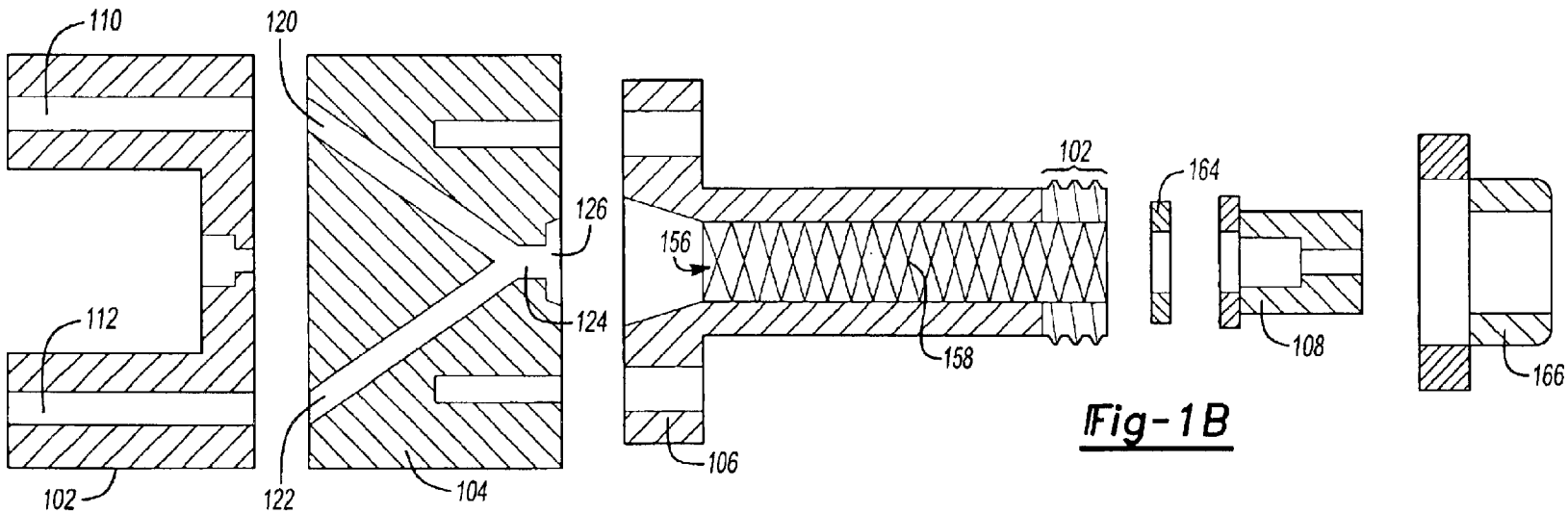
Figure 2:
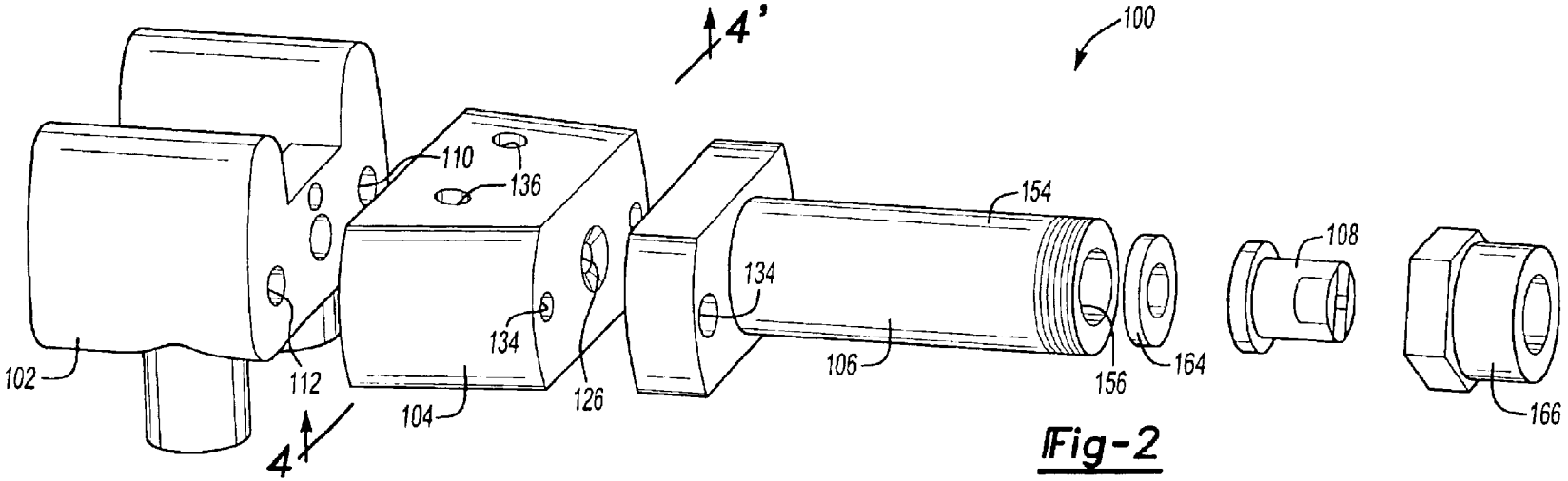
FIG. 2 is an exploded perspective view of the spray gun shown in FIGS. 1A and 1B.
Figure 3:
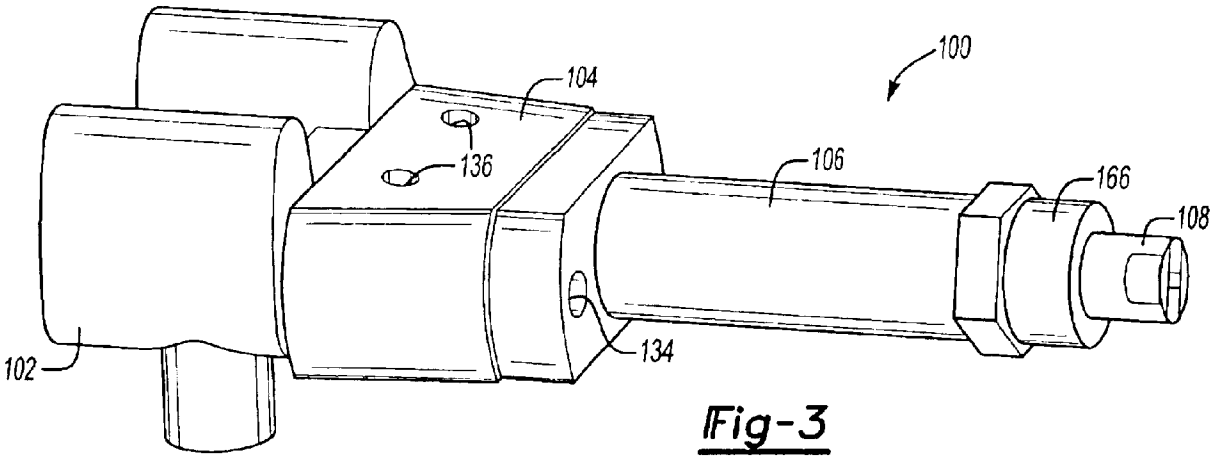
FIG. 3 is an assembled perspective view of the spray gun shown in FIG. 2.

FIGS. 1A through 3 are representative diagrams of the components of a spray gun 100 according to one embodiment of the invention. FIG. 1A is a side view of the spray gun 100 and FIG. 1B is a top view. FIG. 2 is an exploded perspective view of the spray gun 100, and FIG. 3 is an assembled view of the spray gun 100. In the illustrated embodiment, the spray gun 100 includes a valve body 102, a manifold 104, a mixer 106, and a spray tip 108.

Referring to FIGS. 1A and 1B, the valve body 102 includes two flow channels 110, 112. In this example, one flow channel 110 carries a first fluid, such as a catalyst, through the valve body 102 and other channel 112 carries a second fluid, such as a liquid resin. As a result, the valve body 102 keeps the resin and the catalyst separate while still allowing control over the amount of fluid output from the valve body 102 via a valve 114. In one embodiment, the spray gun 100 may include a two-stage trigger or any other known fluid controller (not shown) that can control output of the catalyst and the resin independently so that either fluid can be sent through the valve body 102 alone through its associated channel 110, 112. By keeping the catalyst and the resin separate in the valve body 102, the two-stage trigger allows, for example, the resin alone to be sprayed onto a component in a preliminary wetting operation without requiring a separate stop or valve to prevent output of the catalyst at the same time.

Figure 4:
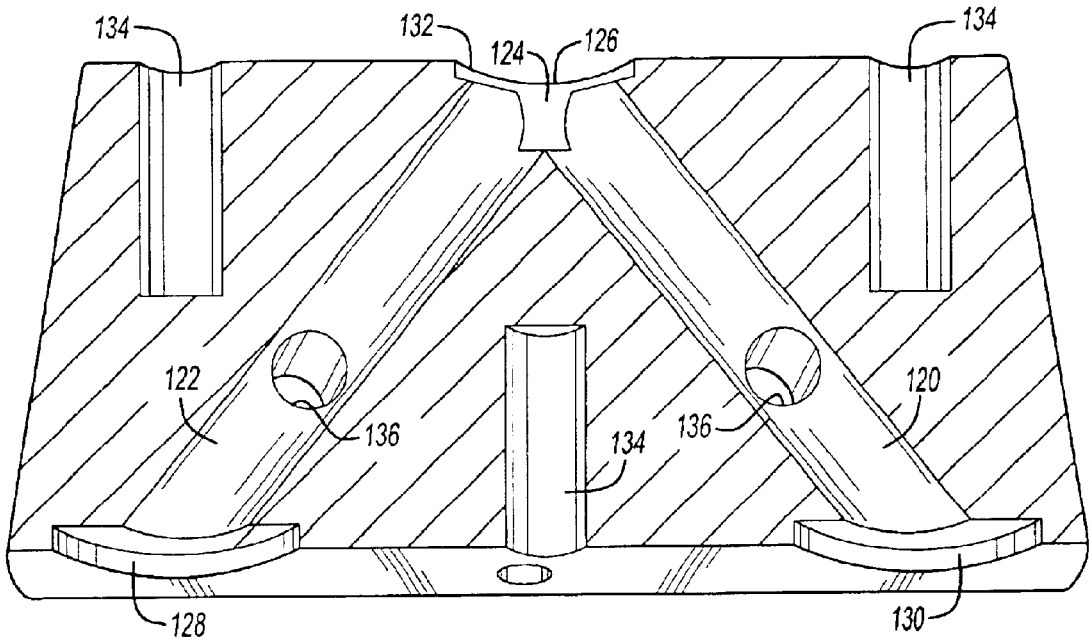
FIG. 4 is a sectional view of a manifold in one embodiment of the inventive spray gun taken along line 4–4' in FIG. 2.

FIG. 4 is a cross sectional view taken along line 4–4' of the manifold 104 shown in FIG. 2 and viewed in the direction of the arrows on line 4–4'. The manifold 104 includes two channels 120, 122 corresponding to the two channels 110, 112 in the valve body 102. Like the valve body 102, the manifold 104 keeps the catalyst and the resin separated via its own two channels 120, 122. The two manifold channels 120, 122 angle toward each other to meet at a vertex 124 inside the manifold 104. At the vertex 124, the catalyst and the resin are allowed to impinge each other inside the manifold 104 before being output together through an output port 126. The vertex 124 is the first point where the catalyst and the resin are allowed to contact each other and start initial mixing, eliminating the danger of starting the polymerization process prematurely and leaving a film in the channels of the manifold 104 or the valve body 102.

The manifold 104 houses three seals 128, 130, 132. In one embodiment, these seals are made of a rigid material, such as Teflon® rather than resilient O-rings to improve the durability and longevity of the seals 128, 130, 132. A seal 128, 130 is disposed at the interface between each manifold channel 110, 112 in the valve body 102 and the corresponding channels 120, 122 in the manifold 104. An exit seal 132 is disposed at the output port 126 of the manifold 104, at the interface between the manifold 104 and the mixer 106.

The manifold 104 also includes mounting holes 134 that can accommodate mounting bolts or screws (not shown) to connect the manifold 104 via corresponding mounting holes to the valve body 102 and to the mixer 106.

Two flushing holes 136, one associated with each channel 120, 122 in the manifold, may be formed in the top surface of the manifold 104 down to the channels 120, 122 to provide conduits for carrying cleaning fluid to the channels 120, 122. The flushing holes 136 stop when they intersect with top of the channels 120, 122 and do not extend all the way through the manifold 104. Because the channels 120, 122 in the manifold 104 carry the catalyst and resin separately, no polymerized film forms in the channels 120, 122. More particularly, the flushing holes 136 are disposed before the vertex 124 where the catalyst and resin first mix via fluid impingement, allowing the channels 120, 122 to be cleaned completely during flushing without leaving any residual polymerized film behind. The flushing process itself involves attaching tubing to the flushing holes 136 and forcing pressurized solvent through the flushing holes 136 and to the manifold channels 120, 122 to clean the channels 120, 122.

In one embodiment, shut-off valves (not shown) may also be coupled to the manifold prior to the vertex to ensure that no additional mixing of the catalyst and resin occurs after the catalyst and resin flow has been shut-off. The shut-off valves also prevent the resin from hardening inside the gun 100 itself.

Once the catalyst and the resin impinge each other at the vertex 124, the catalyst and resin together flow through a manifold exit 138 out of the manifold 104 and into the mixer 106. The mixer 106 includes a plate portion 150 having mounting holes 152 for attaching the mixer 106 to the manifold 104 and the valve body 102, a mixer housing 154 having a mixing bore 156 through which the catalyst and resin travel, and a static mixer 158 disposed inside the mixing bore 156.

Figure 5:
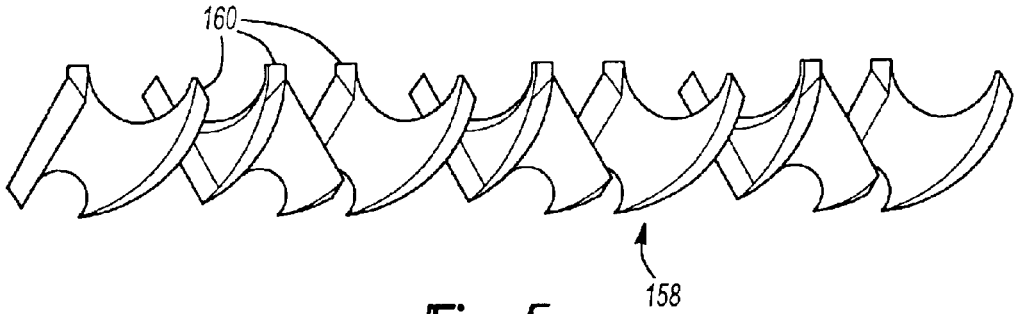
FIG. 5 is perspective view of a static mixer used in one embodiment of the invention.

FIG. 5 illustrates one embodiment of the static mixer 158 in more detail. In this embodiment, the static mixer 158 has a generally helical-shape having a plurality of fins 160 that block fluid from flowing straight through the mixing bore 156. Instead, the impinged catalyst and resin are forced to flow around each individual fin 160 as it travels through the bore 156. As the catalyst and resin travel around each fin 160, the fluid movement required to travel around the fin 160 causes the catalyst and resin to integrate together more thoroughly. By the time the catalyst and resin reaches an output portion 162 of the mixer 106 they are thoroughly mixed together to form a homogenous mixture. Note that the static mixer 158 can have any other configuration that forces the catalyst and resin to mix together more thoroughly as it travels through the bore 156.

The mixture then leaves the mixer 106 through the spray tip 108, which directs the catalyst/resin mixture in a desired spray pattern. A gasket 164 may be disposed between the spray tip 108 and the mixer 106 to ensure a fluid-tight seal. In one embodiment, the output portion 162 of the mixer 106 is threaded to accommodate a tip holder 166 that holds the spray tip 108 and gasket 164 in place on the mixer 106. The tip holder 166 may have an opening 168 through which a portion of the spray tip 108 extends, as shown in FIG. 3.

The spray tip 108 may be attached to the mixer 106 in other ways, including via a permanent attachment, depending on the desired application for the spray gun 100. Note, however, that the illustrated embodiment allows the spray tip 108 to be easily exchanged for other spray tips 108 by simply unscrewing the tip holder 166 from the mixer 106 and replacing the existing spray tip 108 with a new spray tip. The same gun 100 can therefore be used to generate different spray patterns, volumes, etc. without requiring extensive retooling of the gun 100. Further, the spray tip 108 itself may include another static mixer or other mixing structure that further mixes the fluids together. For example, after the two fluids have been sent through the static mixer 106, the spray tip 108 may include structures that separate and join the mixed fluids together to mix the fluids even more thoroughly. By incorporating static mixing structures, the invention can reduce or eliminate the number of moving parts and even reduce the total number of parts in the spray gun 100.

In one embodiment, the channels 110, 112, 120, 122 and the fluxing bore 156 have diameters that are larger than those in currently-used spray guns. The larger diameters allow the inventive spray gun to output the same amount of resin mixture as known spray guns while reducing the fluid velocity through the gun. The relative lark of moving parts in the spray gun 100 also contributes to the slower fluid velocity.

Figure 6:
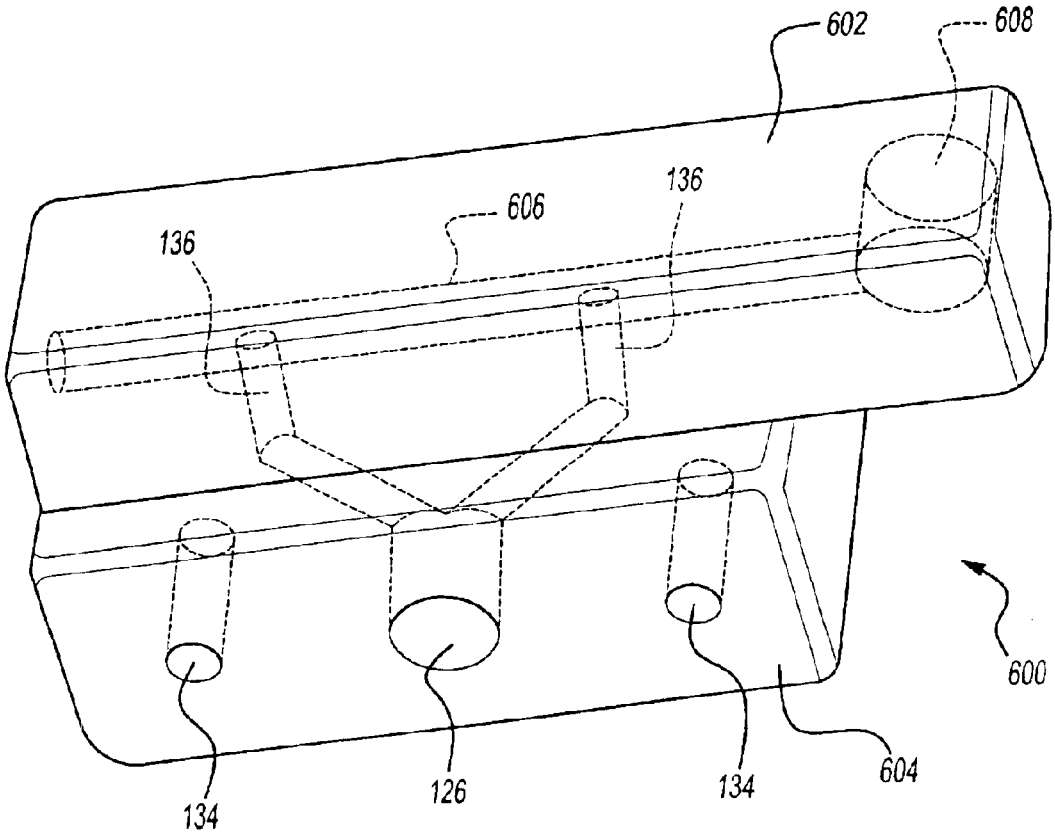
FIG. 6 is a perspective view of a manifold according to another embodiment of the invention.
Figure 7:
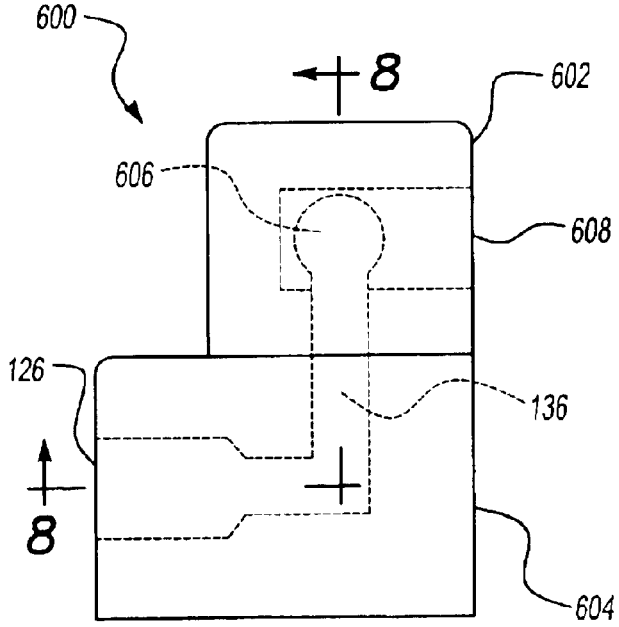
FIG. 7 is a side view of the manifold shown in FIG. 6.
Figure 8:
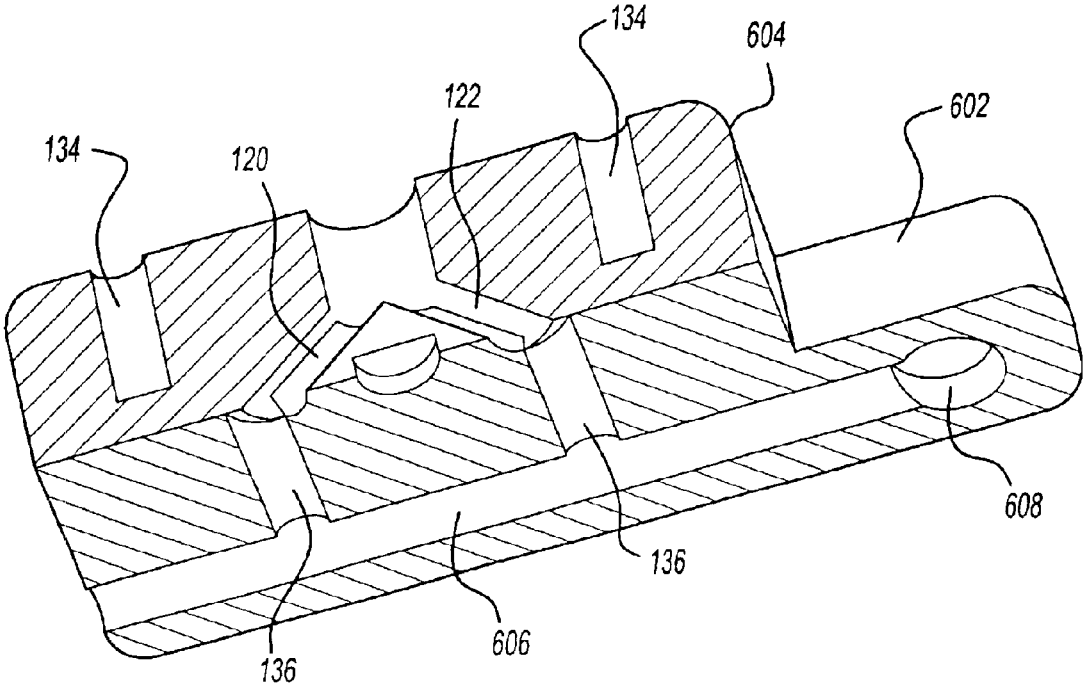
FIG. 8 is a perspective sectional view of the manifold taken along line 8–8' in FIG. 7.

FIGS. 6 through 8 illustrate another embodiment of a manifold structure 600 that can be used in the invention. The manifold 600 shown in FIGS. 6 and 7 may replace the manifold 104 shown in, for example, FIGS. 2 and 3. In this embodiment, the manifold 600 has a flushing structure 602 on top of a manifold body 604. The manifold body 604 has a structure that is similar to the manifold 104 in FIGS. 2 and 3. In one embodiment, the flushing structure 602 has a flush channel 606 that directs fluid to the flushing holes 136 in the manifold body 604. A flush opening 608 provides a path for cleaning fluid to enter the manifold 600, through the flushing holes 136 and down into the channels 120, 122 of the manifold body 604 to flush the channels 120, 122. The flushing structure 602 covers the flushing holes 136, forcing all of the cleaning fluid sent through the flush opening 608 down into the channels 120, 122. Because the flush channel 606 allows cleaning fluid to only flow downward through the flushing holes 136 into the manifold body 604, the structure shown in FIGS. 6 and 7 creates backflow pressure that prevents cross-contamination between the cleaning fluid and any dissolved contaminants inside the channels 120, 122.

As a result, the spray gun 100 according to the present invention reduces the overall number of parts needed in the spray gun 100 as well as avoiding the use of leak-prone O-ring seals in the gun structure. Further, by keeping the resin and catalyst separate until the very last minute, and by incorporating a manifold structure that controls fluid impingement between the catalyst and the resin within the manifold, the inventive spray gun prevents any polymerized film from accumulating inside the channels 110, 112, 120, 122 of both the valve body 102 and the manifold 104. This extends the life of the valve body 102 and manifold 104, reducing the need to replace these parts as frequently. Further, the inventive structure minimizes the total number of moving parts and uses a static mixer 158, the velocity of the fluid travelling through the spray gun 100 tends to be slower than in known spray guns, reducing wear inside the spray gun channels and further reducing the amount of maintenance needed for the gun. Even with the slower fluid velocity, however, the inventive gun structure can process fluid mixtures at flow rates of at least, for example, 35 pounds per minute. Further, impinging the catalyst and the resin together inside the manifold rather than in an external location reduces the total emissions generated by the spray gun.

The above examples focus on maintaining separation between a catalyst and a resin, but the inventive structure can be used in any application that mixes two fluid components together before being applied to a surface. The inventive spray gun structure can be used to apply, for example, paint, foam, chop, gel coats and barrier coats as well as resin. Further, the simple internal design of the invention allows the same gun structure to be used for many different materials instead of designing a separate, dedicated spray gun for each material type.

Although a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A spray gun that outputs a mixture of a first fluid and a second fluid, comprising:

a valve body having a first valve body channel that carries a first fluid, a second valve body channel that carries a second fluid, and a valve that controls a fluid flow through at least one of the first valve body channel and the second valve body channel; and a manifold coupled to the valve body and having a first manifold channel that cooperates with the first valve body channel and a second manifold channel that cooperates with the second valve body channel, wherein the first manifold channel and the second manifold channel converge at a vertex that impinges the first fluid and the second fluid together, wherein the manifold has at least one flushing hole connected to at least one of the first manifold channel and the second manifold channel.

2. The spray gun of claim 1, further comprising:

a mixer coupled to the manifold and having a mixing bore cooperating with the vertex, wherein the first fluid and the second fluid mix together inside the mixing bore before being output through an output portion of the bore.

3. The spray gun of claim 1, further comprising a first seal at an interface between the first valve body channel and the first manifold channel and a second seal at an interface between the second valve body channel and the second manifold channel.

4. The spray gun of claim 3, wherein the first seal and the second seal are disposed in the manifold.

5. The spray gun of claim 3, wherein the first seal and the second seal are made of a rigid material.

6. The spray gun of claim 1, further comprising an exit seal disposed at the vertex in the manifold.

7. The spray gun of claim 6, wherein the exit seal is made of a rigid material.

8. The spray gun of claim 1, wherein the manifold comprises a flushing structure and a manifold body, wherein said at least one flushing hole is in the manifold body and wherein the flushing structure comprises a flush channel fluidically coupled to said at least one flushing hole.

9. The spray gun of claim 8, wherein the flush channel creates a backflow pressure that prevents cross-contamination between a cleaning fluid and a contaminated cleaning fluid in the manifold body.

10. The spray gun of claim 1, wherein the mixer further comprises a static mixer disposed in the mixing bore.

11. The spray gun of claim 1, further comprising a fluid controller coupled to the first valve body channel and the second valve body channel so that the first fluid and the second fluid can be output independently of each other.

12. The spray gun of claim 1, further comprising a spray tip connected to the mixer.

13. The spray gun of claim 12, wherein the spray tip is detachable from the mixer, and wherein the spray gun further comprises a tip holder that connects the spray tip to the mixer.

14. The spray gun of claim 12, wherein the spray tip contains a mixing structure.

15. A spray gun that outputs a mixture of a first fluid and a second fluid, comprising:

a valve body having a first valve body channel that carries a first fluid, a second valve body channel that carries a second fluid, and a valve that controls a fluid flow through at least one of the first valve body channel and the second valve body channel;

a manifold coupled to the valve body and having a first manifold channel that cooperates with the first valve body channel and a second manifold channel that cooperates with the second valve body channel, wherein the first manifold channel and the second manifold channel converge at a vertex that impinges the first fluid and the second fluid together, wherein the manifold has at least one flushing hole connected to at least one of the first manifold channel and second manifold channel;

a mixer coupled to the manifold and having a mixing bore cooperating with the vertex and a static mixer that mixes the first fluid and the second fluid together inside the mixing bore before being output through an output portion of the bore; and a spray tip connected to the mixer.

16. The spray gun of claim 15, further comprising a first seal at an interface between the first valve body channel and the first manifold channel, a second seal at an interface between the second valve body channel and the second manifold channel, and an exit seal disposed at the vertex.

17. The spray gun of claim 16, wherein the first seal, the second seal, and the exit seal are made of a rigid material.

18. The spray gun of claim 15, wherein the manifold comprises a flushing structure and a manifold body, wherein said at least one flushing hole comprises two flushing holes that are in the manifold body, and wherein the flushing structure comprises a flash channel fluidically coupled to at least one of said two flushing holes.

19. The spray gun of claim 18, wherein the flush channel creates a backflow pressure that prevents cross-contamination between a cleaning fluid and a contaminated cleaning fluid in the manifold body.

20. The spray gun of claim 15, wherein the spray tip is detachable from the mixer, and wherein the spray gun further comprises a tip holder that connects the spray tip to the mixer.

21. The spray gun of claim 15, wherein the spray rip contains a mixing structure.

22. A fluid impinging manifold that impinges a first fluid on a second fluid, comprising:

a first channel that carries a first fluid;

a second channel that carries a second fluid, wherein the first channel and the second channel, wherein the first and second channels are disposed in a manifold body and converge at a vertex that impinges the first fluid and the second fluid together;

at least one flushing hole coupled to at least one of the first channel and the second channel; and a flushing structure having a flush channel fluidically coupled to said at least one flushing hole.

23. The fluid impinging manifold of claim 22, wherein the flush channel creates a backflow pressure that prevents cross-contamination between a cleaning fluid and a contaminated cleaning fluid in the manifold body.

* * * * *

UNITED STATES PATENT AND TRADEMARK OFFICE

CERTIFICATE OF CORRECTION

PATENT NO. : 6,811,096 B2
DATED : November 2, 2004
INVENTOR(S) : Frazier et al.

It is certified that error appears in the above-identified patent and that said Letters Patent is hereby corrected as shown below:

Column 6,
Line 54, “flash” should read as -- flush --.
Line 64, “rip” should read as -- tip --.

Signed and Sealed this

First Day of March, 2005

JON W. DUDAS
*Director of the United States Patent and Trademark Office*